US006543791B1

(12) United States Patent
Lee

(10) Patent No.: US 6,543,791 B1
(45) Date of Patent: Apr. 8, 2003

(54) AXLE SHOCK ABSORBER

(75) Inventor: Elmer Lee, 108 Elm St. Apt. 2, Cambridge, MA (US) 02139

(73) Assignee: Elmer Lee, Ann Arbor, MI (US)

( * ) Notice: Subject to any disclaimer, the term of this patent is extended or adjusted under 35 U.S.C. 154(b) by 0 days.

(21) Appl. No.: 09/715,353

(22) Filed: Nov. 17, 2000

Related U.S. Application Data

(60) Provisional application No. 60/170,032, filed on Dec. 10, 1999.

(51) Int. Cl.[7] ..... A63C 17/00

(52) U.S. Cl. ..... 280/11.223; 280/11.225; 301/5.3; 152/47; 384/536

(58) Field of Search ..... 301/5.3, 5.7, 5.1; 152/17, 40, 47, 48; 280/11.221, 11.223, 11.225, 11.226, 11.227, 11.231, 11.233, 11.19, 11.25, 11.27, 11.28; 384/535, 536

(56) References Cited

U.S. PATENT DOCUMENTS

| | | | | | |
|---|---|---|---|---|---|
| 698,110 | A | * | 4/1902 | Foy | 301/5.3 |
| 2,241,685 | A | * | 5/1941 | Ware | 301/5.3 |
| 2,635,923 | A | * | 4/1953 | Isham et al. | 301/5.7 |
| 2,689,769 | A | * | 7/1954 | Ware | 301/5.7 |
| 3,389,922 | A | * | 6/1968 | Eastin | 280/11.223 |
| 3,743,059 | A | | 7/1973 | Morse et al. | |
| 3,951,422 | A | | 4/1976 | Hornsby | |

(List continued on next page.)

FOREIGN PATENT DOCUMENTS

| | | |
|---|---|---|
| EP | 0279131 B1 | 3/1991 |
| EP | 0769313 A2 | 4/1997 |
| EP | 0799629 B1 | 12/1999 |
| WO | WO 95/17231 A1 | 6/1995 |
| WO | WO 97/45179 A1 | 12/1997 |
| WO | WO 98/09691 A1 | 3/1998 |

*Primary Examiner*—Brian L. Johnson
*Assistant Examiner*—Bryan R Fischmann
(74) *Attorney, Agent, or Firm*—Mark S. Leonardo; Brown Rudnick Berlack Israels LLP

(57) ABSTRACT

This invention relates to a hub mounted shock absorber suitable for use in the wheels of in-line skates or other small wheel transportation devices such as scooters, street skis, etc. and to in-line skates utilizing wheels with such hub mounted shock absorbers. The hub mounted shock absorbers include an outer tube with an elastomer, preferably a low durometer elastomer between the outer tube and the axle of the wheel. The elastomer is prefereably sandwiched between the inner and outer tube with the axle passing through the inner tube. Openings may be selectively provided in the outer tube to further reduce the stiffness of the elastomer and flexure or other appropriate mechanism may be included which result in minimum stiffness for the shock absorber in the vertical direction only. A modified hub design to accommodate the hub mounted shock absorber without changing the overall size of the wheel and a novel tire for the wheel to achieve the same objective, and to also increase wheel stiffness are also provided.

28 Claims, 9 Drawing Sheets

U.S. PATENT DOCUMENTS 4,000,912 A 1/1977 Donald et al.
4,090,283 A * 5/1978 Woolley ..... 29/894
T981,004 I4 * 4/1979 McNeely et al. ..... 384/536
4,272,091 A 6/1981 Reid, Jr.
4,294,491 A * 10/1981 Black ..... 301/64.3
4,402,521 A 9/1983 Mongeon
4,403,784 A 9/1983 Gray
4,645,223 A 2/1987 Grossman
4,699,432 A * 10/1987 Klamer ..... 301/5.3
4,898,403 A * 2/1990 Johnson ..... 280/842
4,915,399 A 4/1990 Marandel
5,029,882 A 7/1991 Marandel
5,104,201 A * 4/1992 Ross ..... 301/110.5
5,125,755 A * 6/1992 Adler et al. ..... 384/536
5,135,244 A 8/1992 Allison
5,180,176 A 1/1993 Chen
5,308,152 A * 5/1994 Ho ..... 301/5.3
5,330,208 A 7/1994 Charron et al.
5,393,078 A * 2/1995 Bourdeau ..... 280/11.22
5,398,948 A 3/1995 Mathis
5,405,156 A 4/1995 Gonella
5,470,086 A * 11/1995 Peterson et al. ..... 280/11.22
5,501,531 A * 3/1996 Hamaekers ..... 384/536
5,503,413 A 4/1996 Belogour
5,551,713 A 9/1996 Alexander
5,575,489 A 11/1996 Oyen et al.
5,582,418 A 12/1996 Closser
5,704,620 A 1/1998 Oliemans et al.
5,704,621 A 1/1998 Lazarevich et al.
5,791,665 A 8/1998 Mayer, II
5,823,543 A 10/1998 Burns et al.
5,853,225 A * 12/1998 Huang ..... 301/5.3
5,904,360 A 5/1999 Oliemans et al.
5,918,889 A 7/1999 Tai
5,922,151 A * 7/1999 Piper et al. ..... 152/310
5,951,027 A * 9/1999 Oyen et al. ..... 280/11.22
6,227,622 B1 * 5/2001 Roderick et al. ..... 301/5.3
6,322,153 B1 * 11/2001 Lund ..... 301/5.3
6,406,101 B2 * 6/2002 Lund ..... 301/5.1

* cited by examiner

AXLE SHOCK ABSORBER

RELATED APPLICATIONS

This application claims priority from provisional application No. 60/170,032, filed Dec. 10, 1999.

FIELD OF THE INVENTION

This invention relates to shock absorber systems for use in the wheels of inline skates and other small-wheeled transport devices.

BACKGROUND OF THE INVENTION

While inline skating has enjoyed significant success, with current technology, an almost perfectly smooth pavement is still required to fully enjoy this activity. This has limited inline skating to well-maintained parks and recreational areas. Roads that feel perfectly comfortable to users on cars and bikes leave inline skaters shaken and frustrated.

One reason for this problem is that existing inline skates do not contain any shock absorbing system, relying only on the elasticity of the tire on each wheel to perform this function. While a number of shock absorbing systems have been proposed over the years for inline skates, these have involved modifying the skate itself by adding heavy and bulky springs, dampers, and the like to the skate truck or frame. However, none of these systems are currently being commercially used, primarily because the weight and complexity they add to the skate are not offset by the advantages they provide. The reliance on tire resiliency to absorb road variations also is disadvantageous in that it requires the use of tires which have some softness and resiliency, for example a durometer in the 65–75 range. However, such softer tires result in more tire deformation as it contacts the road surface, requiring the user to exert more energy, and thus limiting the speed attainable with the skate. A harder tire, for example a tire with a durometer in the 85–100, range would provide a faster skate, while requiring the use of less energy by the skater. The absence of an effective shock absorber system on inline skates also results in vibration passing into a user's feet and legs; even on relatively smooth pavements, these vibrations contribute to skater fatigue over time.

Problems similar to those described above exist for other transport devices, particularly ones having small wheels similar to those of inline skates. Such transport devices could include scooters, street skis, some skateboards, and the like.

A need therefore exists for an improved shock absorbing system for use in inline skates and related transportation devices which does not result in any appreciable increase in either weight or bulk for the device, and is relatively simple and inexpensive, while still being capable of absorbing a substantial portion of road vibration without reliance on the tires of the wheels, so as to facilitate a smoother ride on all surfaces while permitting harder, faster tires to be utilized.

SUMMARY OF THE INVENTION

In accordance with the above, this invention provides an inline skate or related transportation device having a plurality of wheels, each of which includes a non-rotating hub inside a rotating tire, with the hub for at least one of the wheels having a shock absorber therein. For preferred embodiments, all of the wheels of the skate or other device have the shock absorber either formed or mounted therein. For preferred embodiments, each of the hubs has an axle passing therethrough, and each shock absorber includes an outer tube and an elastomer, preferably a low durometer elastomer, between the outer tube and the axle. The outer tube may have an array of holes formed in at least a portion thereof which the elastomer may partially pass through. The sizes of the holes in the outer tube may be selected to achieve a desired stiffness for the shock absorber. The shock absorber also preferably includes an inner tube through which the axle passes, the elastomer being sandwiched between the inner and outer tubes.

For preferred embodiments, the shock absorber includes a mechanism which inhibits movement in rotational degrees of freedom and at least reduces movement in all translational degrees of freedom except vertical, there being a reduced stiffness for the shock absorbers in the vertical degree of freedom. To achieve this objective, the elastomer may be mounted within a flexural mechanism, flexure for such mechanism having minimum stiffness in the vertical direction. A replaceable tire may also be provided on each wheel, which tire is preferably of an ultra-hard material.

The invention also includes a wheel for an inline skate or other small wheeled transport device which includes a shock absorber positioned in its hub. The shock absorber may for example include an elastomer, preferably a low durometer elastomer, positioned between an outer tube of the shock absorber and an axial channel of the hub. Holes may be formed in at least a portion of the outer tube, as indicated above, and an inner tube in the axial channel may also be provided, the elastomer being sandwiched between the inner and outer tubes. The shock absorber may also include a mechanism which inhibits movement in rotational degrees of freedom and at least significantly reduces movement in all translational degrees of freedom except vertical, there being a reduced stiffness for the shock absorber in the vertical degree of freedom, the elastomer for example being mounted within a flexure assembly of the type indicated above. The outer tube may also have a shoulder at each end thereof, with a roller bearing being mounted on each shoulder, the hub being attached to the shock absorber through the bearings. The wheel may also include a replaceable tire, which tire preferably has an ultra-hard outer layer of a plastic material over a core of an even harder plastic material. The outer and inner layers of the tire preferably have different appearances so that wear through of the outer layer may be easily seen. The tire may be sufficiently elastic to be fitted over a rotatable rim portion of the wheel, or a two-part rim may be provided along with components for normally holding the two parts together with the tire mounted thereon, the components permitting separation of the parts for tire replacement.

The invention also includes a hub mounted shock absorber of the type indicated above which, at a minimum, includes an outer tube with an elastomer, preferably a low durometer elastomer, mounted in the tube and having an axial channel formed therethrough. A hole array may be formed in the outer tube, as indicated above, and an inner tube may also be provided in the axial channel, as may the mechanism indicated above which inhibits movement in rotational degrees of freedom and at least significantly reduces movement in all translational degrees of freedom except vertical.

Finally, the invention includes a replaceable tire for an inline skate wheel, or wheel of another small-wheeled transportation device, which tire includes an ultra-hard outer layer of a plastic material over a core of an even harder plastic material, which materials may have a different appearance.

The foregoing and other objects, features and advantages of the invention will be apparent from the following more particular description of preferred embodiments of the invention as illustrated in the accompanying drawings, common elements having the same reference numeral in each of the drawings.

IN THE DRAWINGS

FIGS. 4F, 4H, 4J, and 4L are diagrammatic representations of four alternative flexural mechanisms in shock absorbers in their unloaded state, and FIGS. 4G, 4I, 4K and 4M are diagrammatic representations, respectively, of the same four shock absorbers when loaded.

Figure 3A:
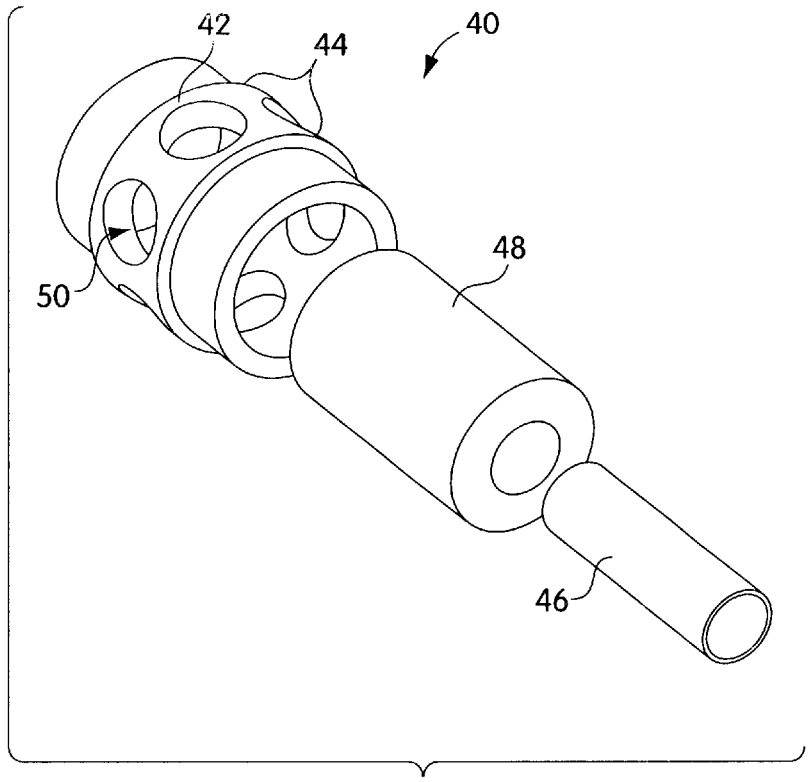
FIGS. 3A and 3B are an exploded perspective view and an assembled perspective view, respectively, of a hub mountable shock absorber for a first embodiment of the invention.
Figure 3B:
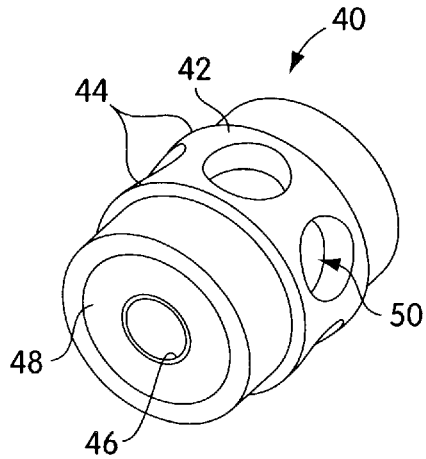
Figure 4A:
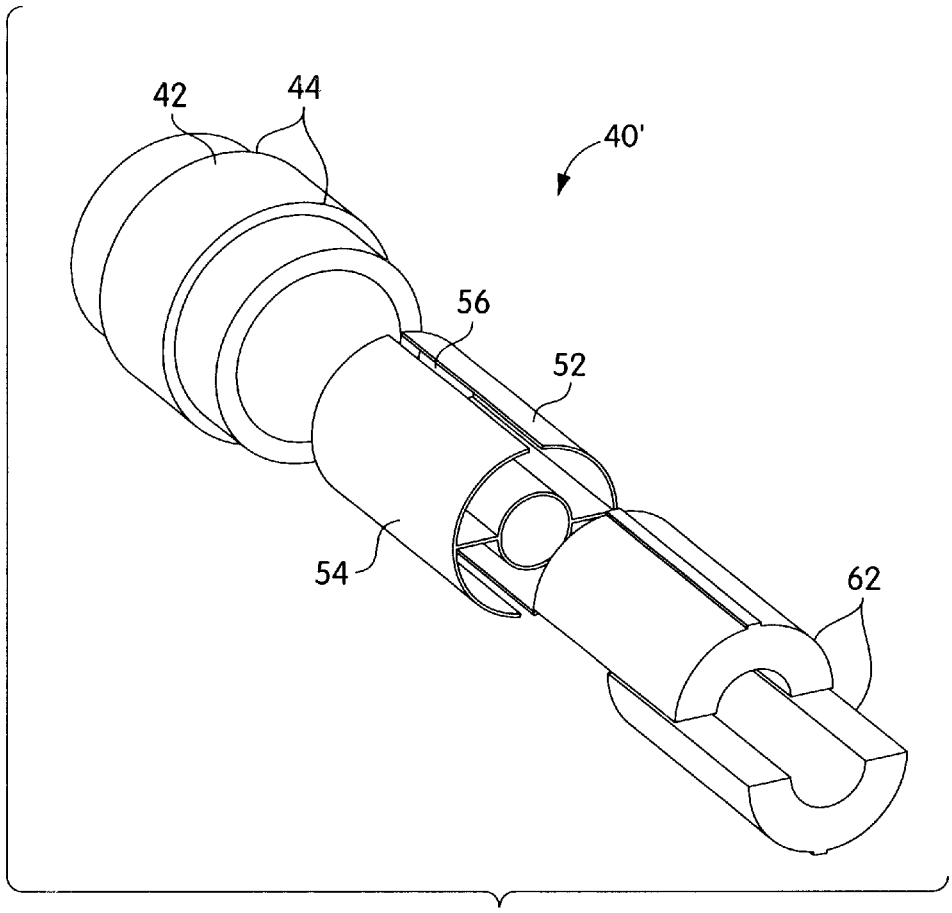
FIGS. 4A and 4B are an exploded perspective view and an assembled perspective view, respectively, of a shock absorber for a second embodiment of the invention incorporating a flexural mechanism.
Figure 4B:
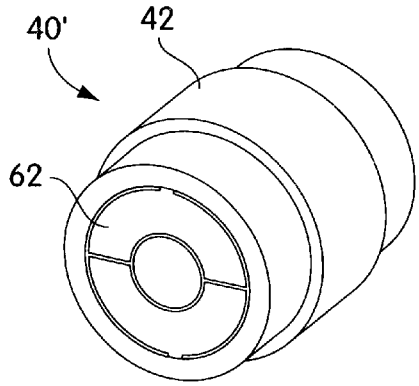
Figure 5A:
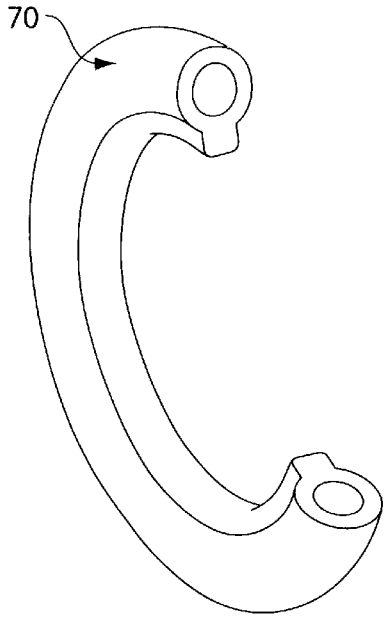
Figure 5B:
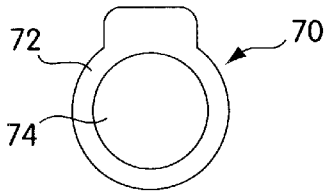
Figure 5C:
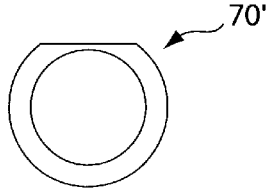
Figure 5D:
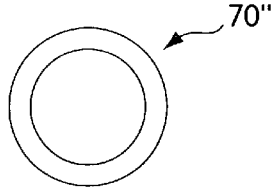
Figure 6A:
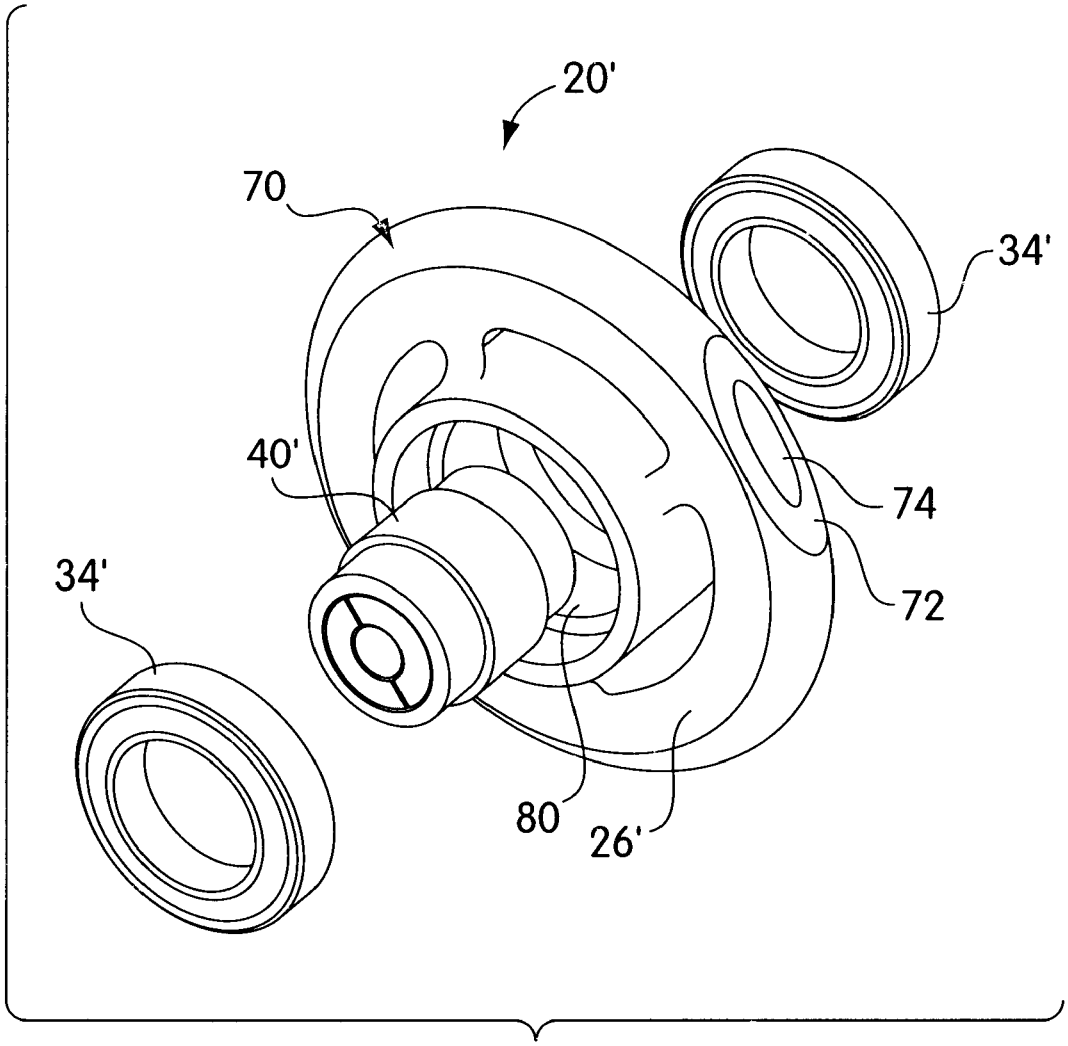
Figure 6B:
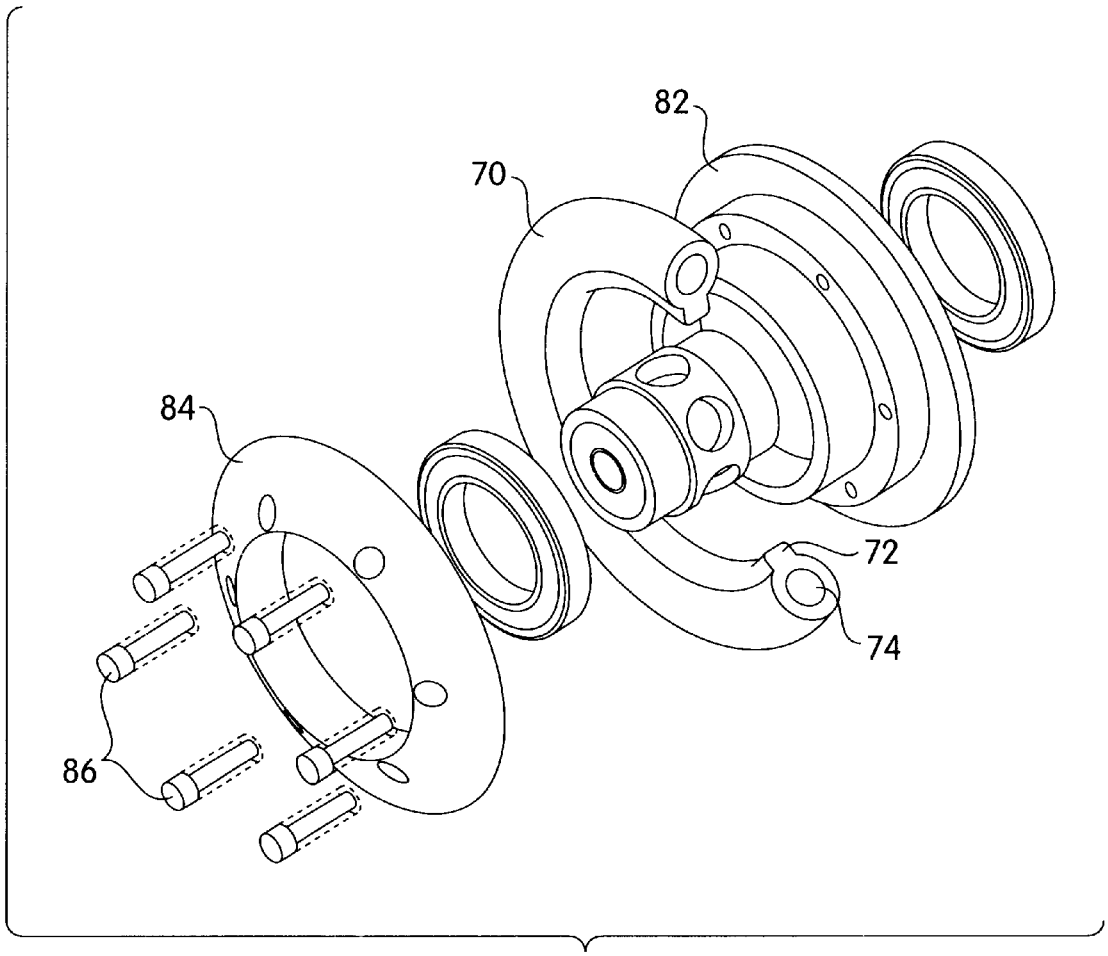

FIG. 5A is a cutaway perspective view of a first embodiment of a tire suitable for use in practicing the teachings of this invention;

FIGS. 5B, 5C and 5D are cross-sectional views of the tire shown in FIG. 5A and of two alternative tire embodiments, respectively; and FIGS. 6A and 6B are exploded perspective views of wheels for a first embodiment of the invention and a second embodiment of the invention, respectively, the wheel in FIG. 6A being shown with flexure hub mounted shock absorber of FIG. 4B, the wheel in FIG. 6B being shown with a non-flexure hub mounted shocker absorber which include the array of damping holes of FIG. 3B.

DETAILED DESCRIPTION

Figure 1:
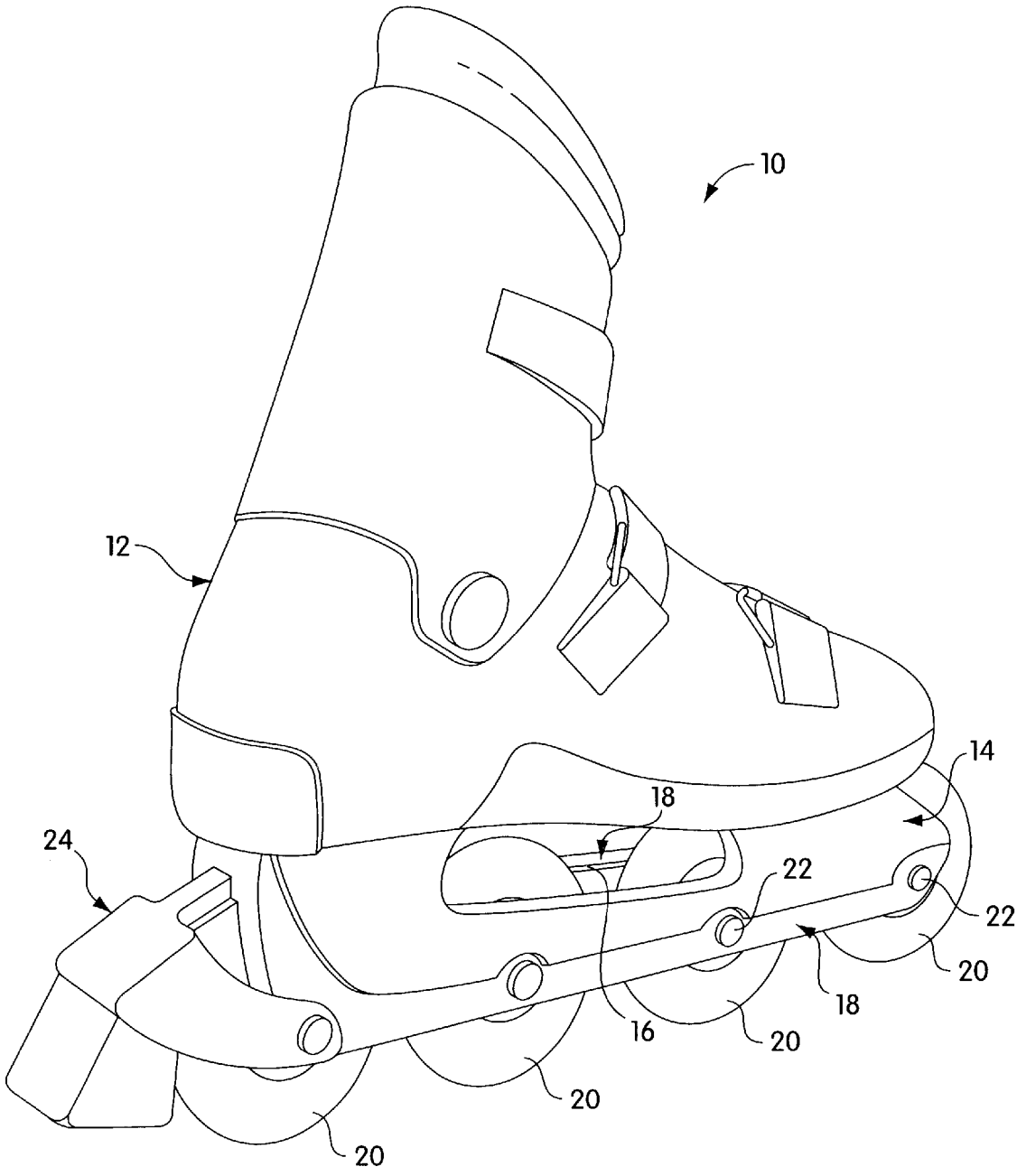
Fig. 1 (Prior Art)
FIG. 1 is a perspective view of an inline skate of a type in which the teachings of this invention might be employed.

FIG. 1 shows an illustrative inline skate 10 which includes a boot 12 mounted to a frame or trunk 14 containing a track 16 formed by a pair of side rails 18. A plurality of wheels 20 are mounted in track 16, four such wheels being shown in FIG. 1. Each wheel is attached to rails 18 by an axial screw 22 which passes through both suitable openings in rails 18 and through the center or axis of each wheel. As is discussed later, a nut is provided for each screw 22 to hold the corresponding wheel in track 16, while permitting easy removal of the wheels when required. A standard braking mechanism 24 is also provided for the skate.

Figure 2:
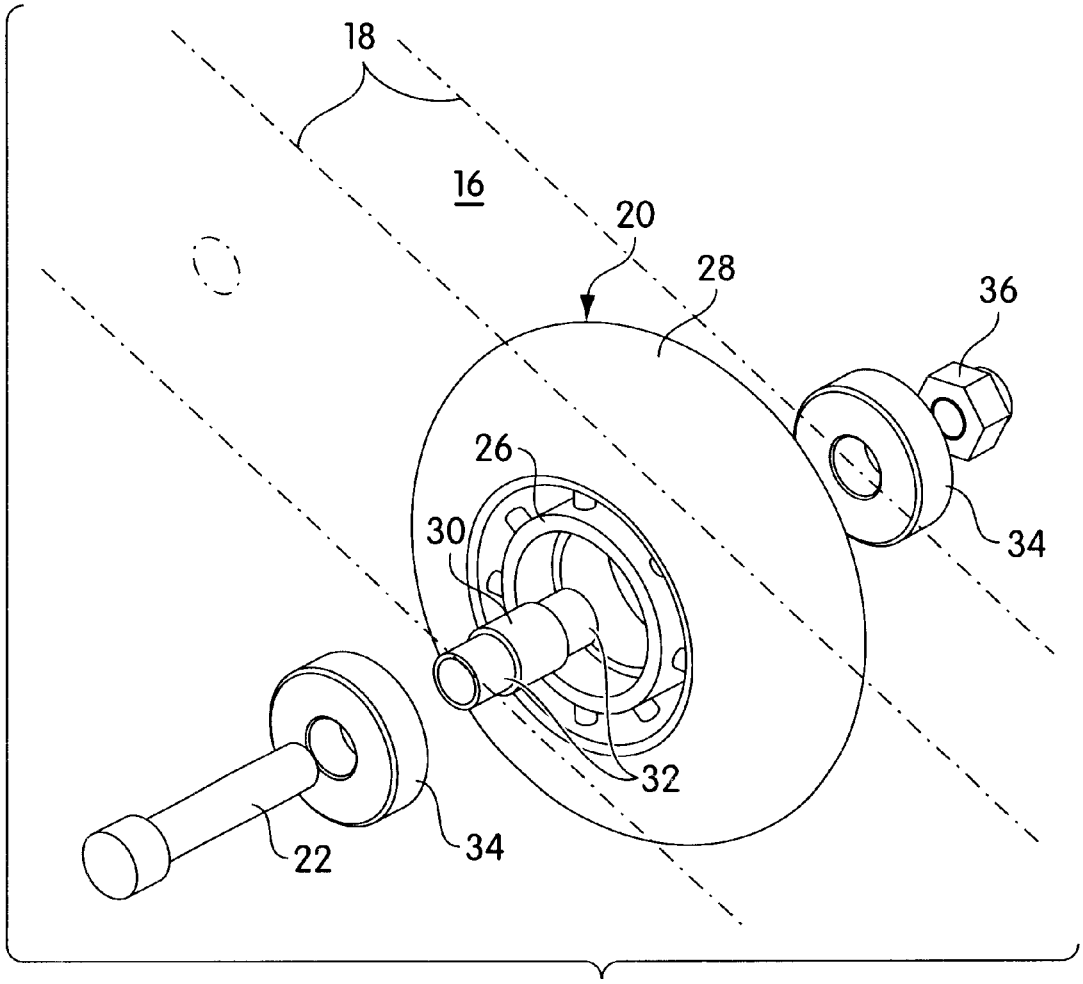
Fig. 2 (Prior Art)
FIG. 2 is an exploded perspective view of an exemplary prior art wheel used in a skate of the type shown in FIG. 1.

FIG. 2 shows a wheel 20 for an illustrative existing inline skate, the wheel including a plastic injection molded hub 26 around which urethane rubber tire 28 is molded. The durometer of tire 28 for existing skates can typically vary from 65 A–85 A. A spacer 30 having a pair of shoulders 32 passes through a center channel in hub 26 and has a roller bearing 34 mounted on each shoulder 32. Axial screw 22 passes through a center channel in spacer 30 and, in conjunction with nut 36, secures wheel 20 in track 16 in skate frame or trunk 14. Roller bearings 34 are snugly fitted in hub housing 26 and facilitate the rotation of the hub and tire 28 about a stationary spacer 30 and screw 22. Wheels 20 may be of several standard diameters, for example 72 mm, 76 mm and 80 mm.

As indicated above, the prior art wheel of FIG. 2 relies only on the elasticity of tire 28 to absorb shock. This is disadvantageous for two reasons. First, tire 28 is not an effective shock absorber, limiting the terrain on which the skates can be enjoyably used, and causing vibration from the skates to be applied to the user's legs, significantly contributing to user fatigue. Second, in order to absorb at least some shock, tire 28 must be formed of a relatively low durometer material, for example a material having a durometer of 65 A–85 A, resulting in greater tire deformation in use and therefore increasing user effort and decreasing optimum skate speed.

In accordance with the teachings of this invention, the above problems are overcome by providing a shock absorber which is mountable in a modified hub 26, the hub mounted shock absorber being designed to absorb significantly more shock than can be absorbed by tires 28. Further, since tires 28 are no longer required to function as the primary shock absorber for the skate, a harder, higher durometer tire 28 may be utilized.

FIGS. 3A and 3B show a hub mounted shock absorber 40 in accordance with a first embodiment of the invention. For this shock absorber, spacer 30 is replaced by a slightly larger outer tube 42 having shoulders 44 formed thereon which perform substantially the same function as the shoulders 32, namely to support a pair of roller bearings, which roller bearings are substantially the same as the roller bearings 34, and in particular have balls which are at least as large as those for the bearing 34, but which have a larger inner diameter so as to be able to snugly fit on shoulders 44. An inner tube 46 is also provided having an inner diameter sized to permit screw 22 to fit therethrough. An elastomer tube 48 is sandwiched between outer tube 42 and inner tube 46. Tube 48 is preferably formed of a low durometer elastomer material, for example a material having a durometer of 25 A–45 A; however, while this durometer range for the elastomer of tube 48 is preferable, it is not a limitation on the invention. The portion of outer tube 42 between shoulders 44 has a plurality of holes or openings 50 formed therein, which holes are shown as being circular in the FIGS. 3A and 3B and have a diameter of ⅜" for an illustrative embodiment. The holes effectively reduce the stiffness of elastomer tube 48 by permitting the elastomer to partially pass through the holes under load. The existence of holes 50, and the ability of the elastomer of tube 48 to pass or squeeze therethrough, provides additional damping. By choosing the correct diameter/size for the holes 50, the damping and elasticity of the shock absorber can be controlled.

Figure 4C:
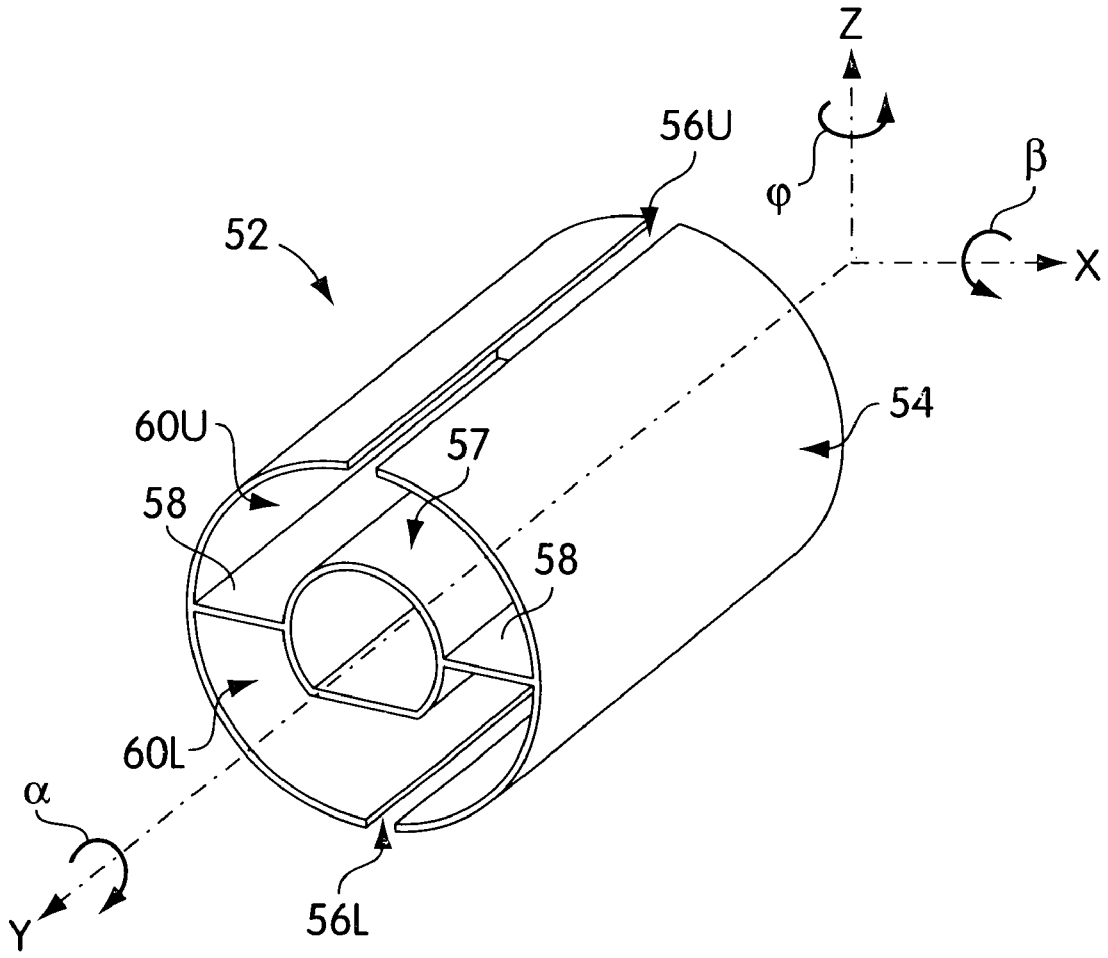
FIG. 4C is a diagrammatic perspective view of a flexural mechanism suitable for use in the second embodiment of FIGS. 4A and 4B.

One problem with the shock absorber of FIG. 3A is that it provides reduced stiffness, not only in the vertical direction (the Z direction in FIG. 4C), but also in the other two lateral directions (X and Y in FIG. 4C) and in the three rotational directions $\alpha$,$\beta$, and $\phi$ of FIG. 4C. The reduced stiffness in all of the lateral and rotational directions other than the vertical Z direction can cause undesirable wobble of the skate wheel. It is therefore desirable that the hub mounted shock absorber 40 be designed so as to provide relatively high stiffness in all rotational directions and added stiffness in all lateral directions except the Z direction, while providing significantly reduced stiffness in the Z or vertical direction.

One possible embodiment that incorporates an anti-wobble feature within the shock absorber system is to modify the damper holes 50. The shape and location of holes 50 may vary and, in particular, holes may be positioned to provide reduced stiffness only in the vertical direction, with greater stiffness in other directions to reduce wobble. As discussed later, such configurations would require a key, flat or other orientation component for the shock absorber.

FIGS. 4A–4M illustrate a shock absorber 40' for an alternative embodiment of the invention which also provides this anti-wobble functionality. In particular, in place of inner tube 46, a flexural spring mechanism 52 is provided, which mechanism includes an outer structure 54 which can be divided into two sections by a pair of slits 56U, 56L extending along its length. Flexural mechanism 52 also includes an inner tube 57 which is connected to each section of outer structure 54 by a corresponding flexible wing 58. The upper and lower spaces 60U and 60L, respectively, between wings 58 and adjacent portions of outer structure 54 are filled with a molded elastomer 62 which is preferably of the same low durometer material as elastomer tube 48. Holes 50 may be provided in outer tube 42, but if this is done, corresponding holes are also required in outer structure 54 so that the elastomer can pass through corresponding holes in both outer structure 54 and tube 42 to reduce stiffness. Where, as will be discussed shortly, there is relative movement between tube 42 and structure 54, holes 50 may need to be slightly larger than the holes in structure 54 so as to maintain the alignment.

Figure 4D:
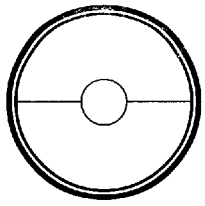
FIGS. 4D and 4E are diagrammatic representations of a shock absorber utilizing a flexural mechanism of the type shown in FIG. 4A when both unloaded and loaded or deformed, respectively.
Figure 4E:
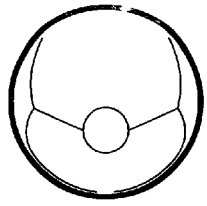
Figure 4F:
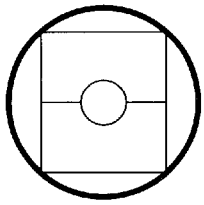
Figure 4G:
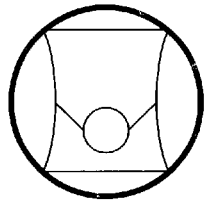
Figure 4H:
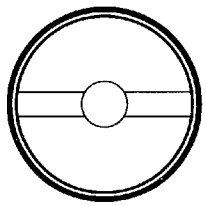
Figure 4I:
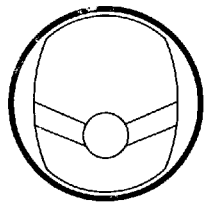
Figure 4J:
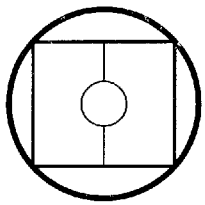
Figure 4K:
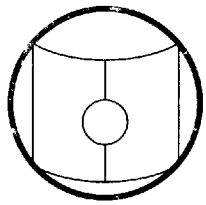
Figure 4L:
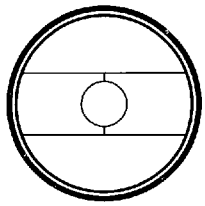
Figure 4M:
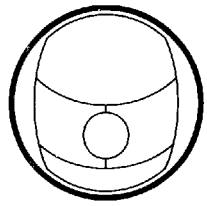

FIGS. 4D, 4E illustrate the operation of the embodiment shown in FIGS. 4A–4C. For this embodiment, wings 58 provide significant stiffness to movement in the X direction and to rotation in the $\phi$ direction about the Z axis. Wings 58 being fixed to the walls of structure 54 also provide significant stiffness against movement in the Y direction, and the fixed relationship between inner tube 57 and outer tube 54 inhibits movement in the $\beta$ direction around the X axis. Finally, the manner in which the flexure works, as shown in FIGS. 4D–4E provides significant stiffness on the a direction about the X axis. However, when a load is applied which moves the wheel up against its axle, flexure mechanism 52 deforms, with the lower sidewalls of outer tube 54 coming together to close the lower slot 56L and the upper walls of tube 54 moving apart to enlarge the upper slot 56U; or, as illustrated in FIG. 4E, slots 56 may be eliminated for the slightly modified embodiment. The reverse occurs for flexural mechanism 52 when a force is applied which would lower the wheel relative to its axle (i.e., a rut is hit in the pavement). To achieve the flexure shown in FIG. 4E, the material of flexural mechanism 52 should be of a plastic, metal or other suitable material having spring-like properties. FIGS. 4F, 4H, 4J and 4L show four alternative flexural mechanisms which might be used in lieu of flexural mechanism 52 with the mechanisms in their unflexed positions, while FIGS. 4G, 4I, 4K and 4M, respectively, show these four flexural mechanisms in their flexed position under load. However, the particular flexural mechanisms shown in the FIGS. 4A–4M are by way of illustration only, and other flexural mechanisms capable of providing substantial stiffness in five dimensions, with controlled reduced stiffness in a single lateral direction could also be utilized.

One potential problem with the shock absorber 40' of FIGS. 4A–4M is that the design is no longer axially symmetric, and a feature may be necessary to assure the shock absorber is properly oriented in the wheel so that the reduced stiffness direction is in fact the Z or vertical direction. A variety of key ways or other orientation mechanisms known in the art could be utilized for this function. One example of an orienting mechanism is shown in the FIGS. 4C wherein inner tube 57 has a flat side which mates with a corresponding flat on axle screw 22. Flats may also be provided on the corresponding openings in rails 18 to assure proper orientation.

Since, as indicated earlier, outer tube 42, 42' will almost certainly be larger than spacer 30 for a conventional inline skate, a larger bearing 34 is also needed, and thus a larger bore in wheel hub 26. Thus, while conventional wheels-use a metric bearing with an 8 mm bore, 22 mm outer diameter and a 7 mm thickness, shoulders 44 of the shock absorber will be designed to permit use of a larger commercially available metric bearing, for example one with dimensions of 20 mm bore, 37 mm outer diameter and 9 mm thickness, the increased thickness being a function of available commercial bearings with the required bore size. Commercial bearings having other larger bore sizes could also be utilized.

Further, since it is desirable that the overall size of the wheel not change so that the wheel can be used in existing inline skate designs, and can be retrofitted to existing skates, the increased hub size can result in a reduced size for tire 28. These smaller tires can also be made harder, since they are no longer the main shock absorbing mechanism.

One potential drawback with the smaller tires is wear. Even though the harder rubber, whether natural or artificial, or other plastic material utilized for the tire will make the tire more wear resistant, the reduction in the volume of rubber for the tire will reduce the wear life of the wheel. In order to allow the cost of wheels to remain substantially unchanged for the consumer, one option is for the overall wheel design to be changed, with only the tire needing to be replaced when worn, rather than the entire wheel. Thus, the hub can become reusable, as it is not generally damaged by wear or use.

The replaceable rubber/plastic tires can be formed in a variety of O-ring like shapes, one such shape being shown in a cutaway perspective view in FIG. 5A and in the cross-section of FIG. 5B. Two alternative shapes are shown in cross-sectional views 5C and 5D.

In order to signal the user that it is time to change the tire on a wheel due to wear, the tire can be manufactured using a two-layer construction, as shown in FIG. 5, with the outer layer 72 being of an ultra hard or stiff rubber or other plastic material, for example a material having a durometer of 85 A–90 A, an inner layer 74, which does not need to normally contact the surface being ridden on, being of an even harder plastic material, for example a material with a durometer in the 95 A–100 A range. However, these suggested ranges are by way of examples only, and other ranges of hardness/stiffness for the tire layers are also possible, or a single layer tire could be utilized. One advantage of the two-layer tire shown in the Figures is that the layers 72, 74 can be formed to have a different appearance, for example being formed of different colors, so that when a tire wears through outer layer 72, exposure of inner layer 74 is easily seen, alerting the user that a tire change is required. The difference in appearance can result from a different color, hue, texture or other easily discernible difference.

The new wheel design with the replaceable tire concept and the shock absorber 40, 40' requires some complementary changes in hub design. In addition to enlarging the opening in the center of the hub to accommodate shock absorber 40, 40', the hub may need to be designed as either a one-piece hub or a two-piece hub depending on whether the tire used is sufficiently elastic so as to be easily removed from the hub when worn, perhaps by use of a special tool or tools, and a new tire stretched to fit on the hub as a replacement. FIG. 6A illustrates a wheel of this type, including an axial shock absorber unit 40' and a pair of enlarged bearings 34'. The hub 26' for this wheel 20' has an enlarged center opening 80, sized to snugly accommodate shock absorber 40', bearings 34' and a rim over which tire 70 may be stretched to fit. A cut away is shown in tire 70 to illustrate inner layer 74.

However, because of the high durometer rubber/plastic preferably used for tire 70, the tires will normally be too stiff to be sufficiently stretchable to fit over the rim of hub 26', and will probably be substantially unstretchable. Therefore, a two piece hub as shown in FIG. 6B is normally required. This hub has a main body 82 on which tire 70 is fitted and is held in place by a hub cap 84 attached to main body 82 by hub screws 86. Once assembled, the hub of FIG. 6B functions substantially the same as that of FIG. 6A.

The embodiments illustrated in FIG. 6A and FIG. 6B do not suggest that different combinations of the technologies and devices are not possible and have not been developed. For example, the two piece hub is as compatible with a flexural shock absorber 40' as with a non-flexural shock absorber system 40. Also, while for the embodiment of FIGS. 3A, 3B, an inner tube 46 is shown, and the use of an inner tube is preferred, this is not a limitation on the invention, and the shock absorber 40 could be designed without such tube.

A hub-mounted shock absorber for an inline skate is thus provided which permits enhanced enjoyment and comfort for inline skating, even on less than perfect skating surfaces and which, by facilitating the use of harder/stiffer tires, enhances both skater efficiency and speed. While the discussion above has been with respect to inline skates and wheels for such skates, and this is the currently preferred application for the invention, wheels employing the shock absorber teachings of the invention could be used on other wheeled transportation devices, including, but not limited to, scooters, street skis, some skateboards and the like. Further, while specific shock absorber, wheel and tire designs have been disclosed for implementing this concept, these designs are being provided by way of illustration only and the foregoing in other changes in form and detail may be made in the invention by one skilled in the art while still remaining within the spirit and scope of the invention, which is to be defined only by the appended claims.

What is claimed is:

1. An inline skate having a plurality of wheels, each of which includes a non-rotating hub inside a rotating tire, each of said hubs having an axle passing therethrough, the hub for at least one of said wheels having a shock absorber therein, said shock absorber including an outer tube and an elastomer between said outer tube and said axle, an array of holes being formed in at least a portion of said outer tube through which said elastomer may partially pass.

2. A skate as claimed in claim 1, wherein the hub for each of said wheels has a shock absorber therein.

3. A skate as claimed in claim 1, wherein sizes for said holes are selected to achieve a selected stiffness for said shock absorber.

4. A skate as claimed in claim 1, including an inner tube through which said axle passes, said elastomer being sandwiched between said inner and outer tube.

5. An inline skate having a plurality of wheels, each of which includes a non-rotating hub inside a rotating tire, each of said hubs having an axle passing therethrough, the hub for at least one of said wheels having a shock absorber therein, said shock absorber including an outer tube, an elastomer between said outer tube and said axle and a mechanism which inhibits movement in rotational degrees of freedom and in all translational degrees of freedom except vertical, there being reduced stiffness for the shock absorber in the vertical degree of freedom.

6. A skate as claimed in claim 5, wherein said elastomer is a low durometer elastomer.

7. A skate as claimed in claim 5, wherein said elastomer is mounted within a flexural mechanism, flexure for said mechanism having minimum stiffness in said vertical direction.

8. A skate as claimed in claim 5, including a replaceable tire on each said wheel.

9. A skate as claimed in claim 5, wherein each said tire is of ultra hard material.

10. A wheel for a small-wheeled transportation device including a non-rotating hub inside a rotating tire, said hub having an axial channel therethrough; and a shock absorber positioned in said hub, said shock absorber including an outer tube and an elastomer between said outer tube and said axial channel, an array of holes being formed in at least a portion of said outer tube through which said elastomer may partially pass.

11. A wheel as claimed in claim 10, wherein sizes for said holes arm selected to achieve a selected stiffness for said shock absorber.

12. A wheel as claimed in claim 10, including an innter tube in said axial channel, said elastomer being sandwiched between said inner and outer tube.

13. A wheel as claimed in claim 10, wherein said outer tube has a shoulder on each end thereof, and including a roller bearing mounted on each said shoulder, said hub being attached to said tire by said roller bearings.

14. A wheel as claimed in claim 10, including a replaceable tire.

15. A wheel as claimed in claim 14, wherein said tire is sufficiently elastic to be fitted over a rotatable rim portion of said wheel.

16. A wheel as claimed in claim 15, including a two-part rim for said tire which rotates with said tire, and components for normally holding said two parts together with said tire mounted thereon, said components permitting separation of said parts for tire replacement.

17. A wheel as claimed in claim 10, wherein each said tire is of ultra hard material.

18. A wheel as claimed in claim 17, wherein said tire has an ultra hard outer layer of a plastic material over a core of an even harder plastic material.

19. A wheel as claimed in claim 18, wherein said outer layer and core have a different appearance.

20. A wheel for a small-wheeled transportation device including a non-rotating hub inside a rotating tire, said hub having an axial channel therethrough; a shock absorber positioned in said hub, said shock absorber including an outer tube and an elastomer between said outer tube and said axial channel; and a mechanism which inhibits movement in rotational degrees of freedom and in all translational degrees of freedom except vertical, there being reduced stiffness for the shock absorber in the vertical degree of freedom.

21. A wheel as claimed in claim 20, wherein said elastomer is mounted within a flexural mechanism, flexure for said mechanism having a minimum stiffness in said vertical direction.

22. A hub mounted shock absorber for use in a wheel of a small-wheeled transport device including an outer tube, an elastomer mounted in said tube and having an axial channel formed therethrough, and a mechanism which inhibits movement in rotational degrees of freedom and in all translational degrees of freedom except vertical, there being reduced stiffness for the shock absorber in the vertical degree of freedom.

23. A shock absorber as claimed in claim 22, wherein said elastomer is a low durometer elastomer.

24. A shock absorber as claimed in claim 22, including an array of holes formed in at least a portion of said outer tube which said elastomer may partially pass through.

25. A shock absorber as claimed in claim 24, wherein sizes of said holes are selected to achieve a selected stiffness for said shock absorber.

26. A shock absorber as claimed in claim 22, including an inner tube in said axial channel, said elastomer being sandwiched between said inner and outer tubes.

27. A shock absorber as claimed in claim 22, wherein said elastomer is mounted within a flexural mechanism, flexure for said mechanism having minimum stiffness in said vertical direction.

28. A shock absorber as claimed in claim 22, wherein said outer tube has a shoulder on each end thereof, and including a roller bearing mounted on each said shoulder.

* * * * *